US008029648B2

(12) United States Patent
Spindler

(10) Patent No.: US 8,029,648 B2
(45) Date of Patent: Oct. 4, 2011

(54) PROCESS AND DEVICE TO MOISTEN A WEB OF MATERIAL

(75) Inventor: Jörg Spindler, Schwäbisch Gmünd (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 12/627,075

(22) Filed: Nov. 30, 2009

(65) Prior Publication Data

US 2010/0084104 A1 Apr. 8, 2010

Related U.S. Application Data

(63) Continuation of application No. PCT/EP2008/054217, filed on Apr. 8, 2008.

(30) Foreign Application Priority Data

May 31, 2007 (DE) ..... 10 2007 025 611

(51) Int. Cl.
*D21F 5/18* (2006.01)

(52) U.S. Cl. ..... 162/207
(58) Field of Classification Search ..... 162/207, 162/289; 239/341, 124
See application file for complete search history.

(56) References Cited

U.S. PATENT DOCUMENTS

| | | | | | |
|---|---|---|---|---|---|
| 3,320,676 | A | * | 5/1967 | Speers | 34/381 |
| 3,735,929 | A | * | 5/1973 | Pleines | 239/341 |
| 3,838,000 | A | | 9/1974 | Urbas | |
| 4,907,741 | A | * | 3/1990 | McIntyre | 239/124 |
| 4,945,654 | A | | 8/1990 | Mason | |
| 5,368,233 | A | * | 11/1994 | Brusko | 239/290 |
| 5,618,001 | A | * | 4/1997 | Del Gaone et al. | 239/346 |
| 6,006,443 | A | | 12/1999 | Karvinen | |

FOREIGN PATENT DOCUMENTS

| | | | |
|---|---|---|---|
| DE | 1 293 565 | | 4/1969 |
| DE | 29 25 026 | A1 | 1/1981 |
| DE | 10 2005 031 444 | A1 | 1/2007 |
| WO | 2004/063463 | A1 | 7/2004 |
| WO | 2007/003059 | A1 | 1/2007 |

OTHER PUBLICATIONS

International Search Report dated Jul. 24, 2008 for PCT/EP2008/054217 (6 pgs).
English translation of International Preliminary Report on Patentability dated Feb. 2, 2010 for PCT/EP2008/054217 (6 pgs).
English translation of Written Opinion of the International Searching Authority (undated) for PCT/EP2008/054217 (5 pgs).

* cited by examiner

*Primary Examiner* — Mark Halpern
(74) *Attorney, Agent, or Firm* — Taylor IP, P.C.

(57) ABSTRACT

In a method for moistening a material web, particularly a moving web, particularly a paper or cardboard web, the moisture is applied onto the material web via at least two medium flows of different temperatures, particularly two vapor flows, or one vapor flow and one gas flow.

23 Claims, 3 Drawing Sheets

PROCESS AND DEVICE TO MOISTEN A WEB OF MATERIAL

CROSS REFERENCE TO RELATED APPLICATIONS

This is a continuation of PCT application No. PCT/EP2008/054217, entitled "METHOD AND DEVICE FOR MOISTENING A MATERIAL WEB", filed Apr. 8, 2008, which is incorporated herein by reference.

BACKGROUND OF THE INVENTION

1. Field of the Invention

The invention pertains to a process and a device to moisten a layer of material (which can be referred to as a web of material), in particular, a moving layer of paper or cardboard.

2. Description of the Related Art

It is already well known that the qualitative properties of paper, in particular the shine, the smoothness and the dampness, can be influenced by adding steam through blower chests or steam moistening applicators to the calender, either along the machine running direction or transverse to it. The increase in moisture content that can be achieved by using pure steam is, however, limited.

A spray device, known from pamphlet WO 2007/003059 A1, utilizes a special nozzle at the calender, in order to add condensation to the steam, thus adding to the total moisture content of the steam that is applied onto a layer of material. Such a spray device can be used for cross profiling. The device does however tend to form droplets and lead to obstructions in the pipe which supplies the condensate, since the pipes need to be very thin in order to avoid the formation of drops. So called overhead compartments are in this context especially critical.

A method to moisten a layer of material, presented in pamphlet DE 29 25 026 A1, shows how water is added to the steam as it exits the nozzles.

According to pamphlet WO 2004/063463 A1 the layer of material is treated by a steam blower chest with additional water. In this instance, there is again the risk of developing droplets.

What is needed in the art is to provide an improved method and an improved device of the initially described type, while avoiding any of the previously mentioned negative side effects. This method is intended to apply moisture in a controlled fashion over different discrete zones onto a moving web of material, in particular a web of paper or cardboard, before and/or at a calender to influence the dampness, the shine and/or the smoothness, either transversely to or along the direction of movement of the machine (which can also be referred to as the direction of movement of the web or the machine direction).

SUMMARY OF THE INVENTION

In regards to the process, the approach of this invention is to use at least two streams of medium applied at different temperatures onto the web of material. The two or more streams of medium may include two streams of steam or one stream of steam and one stream of gas.

Since the streams of medium are applied at different temperatures onto the web of material, in particular a web of paper or cardboard, they do carry different volumes of moisture or droplets, and make it thus possible to add to the level of dampness of the web of material.

The streams of medium applied at different temperatures are therefore intended to control the moisture profile transverse to the machine direction, the moisture profile along the machine direction, and/or the moisture level or dampness of the web of material.

It is of particular advantage to apply moisture in a controlled fashion over the different discrete zones, across the web of material, transversely to the machine direction, and to employ for each of these zones at least two streams of medium, which are applied at different temperatures.

It would be furthermore suitable to employ a stream of steam, in particular superheated steam, for the hotter of the two streams of medium.

According to a preferred convenient version of the process proposed by this invention, the temperature of the hotter of the two streams is basically kept constant and/or the temperatures of the hotter of two streams in any particular zone are basically kept constant.

It is preferred to separately control the temperatures of each of the relatively cooler of two streams in any particular zone, so that a desired profile can be achieved.

A particularly convenient version of the process proposed by this invention is characterized by both of the streams of medium, in particular two streams of steam, which are kept at different temperatures, coming from a common supply, in particular a steam supply, and that one of these two streams of medium, in particular steam, is being cooled. As the result of cooling, the cooler of the two streams of medium, in particular steam, can be converted into saturated or even wet steam.

The moisture content that is intended to be applied to the web of material is therefore best adjusted and/or controlled by cooling this particular stream of medium.

According to a convenient version of the process proposed by this invention, this particular stream of medium is cooled directly. In order to provide direct cooling to this stream it is advantageous to introduce condensate into this stream. It is preferred to gauge the level of condensate entering the stream with a metering device.

According to a convenient alternative version, the stream of medium can also be cooled indirectly. Indirect cooling is most appropriately facilitated by a heat sink with a separate coolant cycle. The coolant is most conveniently controlled in a desired manner by a metering device.

To control certain properties of the processed web of material, it is advantageous if the volume of the stream of relatively cooler medium and/or the volume of the stream of relatively hotter medium are being adjusted. This type of control provides a way to influence certain properties such as the dampness, the shine or the smoothness according to the "smoothing iron concept."

According to a preferred convenient version of the process proposed by this invention, the two streams of media, which are kept at different temperatures, converge in a nozzle, onto which the web of material impinges.

According to a preferred alternative version of the process, the two streams of media, which are kept at different temperatures, can also be brought together after exiting from their respective nozzles, and before they impinge on the web of material.

The moistening device proposed by this invention therefore distinguishes itself by including a steam moistening applicator to deliver moisture, containing at least two streams of medium at different temperatures. These two or more streams of medium can include either two streams of steam or one stream of steam and one stream of gas.

It is of particular advantage to utilize the process and/or device proposed by this invention to control the dampness, the shine and/or the smoothness of a web of material, in particular of a web of paper or cardboard, and in particular before or at a calender. It is furthermore conceivable to establish profiles transversely or along the machine direction.

The application of moisture in a controlled fashion over different discrete zones can be facilitated by two streams of medium, in particular streams of steam, which are kept at different temperatures. The hotter tempered stream of medium, preferably superheated steam, can in this instance be kept at a constant temperature. The second stream of medium, which comes from the same supply line as the first stream, and which is kept at the higher temperature, can be separately cooled by suitable heat sinks in each of the distinctly targeted zones, and thereby brought into the saturated or wet state. In these instances, the respective heat sinks can be used to meter the quantities of applied medium.

The two streams of medium can be brought together in a nozzle as they are applied onto the web of material. The stream of medium that is at the relatively higher temperature, or the superheated steam, respectively, can be used as carrier medium for the other stream, i.e. wet steam, in order to avoid the development of droplet at the steam moistening applicator.

Alternatively, the two streams of medium can be brought together after exiting a nozzle, before they impinge on the web of material. The different streams of media contain different amounts of moisture, i.e. volumes of droplets, thus providing added amounts of moisture to the web of material.

The previously mentioned cooling can be achieved directly or indirectly. Direct cooling can be achieved by introducing condensate to the stream of medium, the volume of which can be varied by a suitable metering device. Indirect cooling can be achieved by a heat sink, which would be equipped with a separate coolant cycle and which functions as a heat exchanger. In this instance, the volume of coolant employed in the cooling cycle can be accurately metered.

Each method of cooling can be complemented by adjusting the volume of the first stream of medium, which is kept at a higher temperature, as well as the volume of the second stream of medium, which is kept at the lower temperature, both in order to optimize the qualities of the web of material, or paper, respectively. This, again, necessitates a suitable metering device.

For optimum control, one can employ various sensors to monitor pressure and temperatures, and as an added option, optical sensors to monitor the transparency of the steam, which will provide conclusions about the size of droplets and/or the water content of the steam.

Reducing the risk of obstructing any of the smaller, drilled openings improves the performance and operational availability of the equipment. Furthermore, it makes the management of metering easier. Instead of using the conventional combinations of steam and water or air and water, the invention proposes two distinctly different streams of medium. This allows the added capability to cool one of the two streams of medium in order to adjust particular qualities of the web of material, in particular relevant paper qualities such as the dampness, the shine or the smoothness in specific discrete zones transversely to the machine direction and/or along the machine direction.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
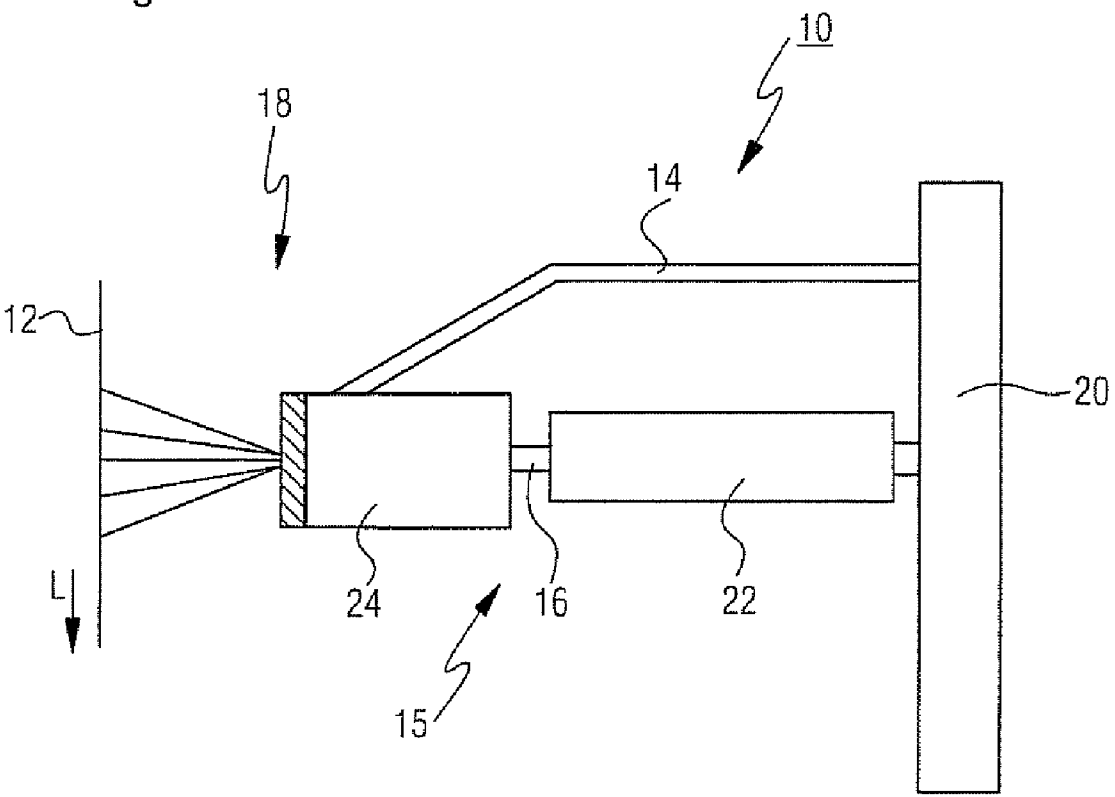
FIG. 1 is a simplified schematic representation of an example of a moisturizing device according to this invention, where the streams of steam, which were kept at different temperatures, are brought together inside of a nozzle.

Referring now to the drawings, and more particularly to FIG. 1, there is shown a simplified schematic of an exemplary version of a device 10 to moisten particularly a moving web of material 12, in particular a web of paper of cardboard.

The moisturizing device 10 includes a steam moistening applicator 18 to apply moisture through two streams of steam 14 and 16 that are kept at different temperatures, and which is particularly suited to influence the moisture profile transverse to the machine direction, the moisture profile along the machine direction, and/or the moisture level of the web of material 12.

The explanations of the figure depicting the first version cites, as an arbitrary example, that the streams of medium 14 and 16 are two streams of steam. Other conceivable versions may replace two streams of steams, by one stream of steam and one stream of gas or something else of that sort, all of which are fully capable of realizing the required objectives.

In this context, steam moistening applicators 18 might be implemented that apply moisture in a controlled targeted fashion over different discrete zones onto a moving web of material 12 transversely to the direction of movement of the web (which can also be referred to as the machine direction) L. In this instance, the moisture that is being applied to a particular zone on the web of material 12 can be supplied through at least two such streams of steam 14 and 16, both of which are being applied at different temperatures.

The relatively hotter of the two streams of steam 14 can be supplied, in particular, by a stream of superheated steam.

The moisturizing device 10 can be arranged, in particular, such that the temperature of the stream of medium that is applied at the relatively higher temperature 14 is basically kept constant and/or such that the temperatures of the hotter of two streams of medium 14 distributed across any particular zone are basically kept constant.

In contrast, the temperature of the relatively cooler stream of medium 16 distributed across any particular zone can each be preferably controlled separately. For the preferred arrangement of the steam moistening applicator 18 whereby moisture is applied in a controlled fashion over different discrete zones onto a web of material 12, the temperatures of each of the relatively cooler streams of medium 16 can each be controlled separately.

As depicted in FIG. 1, the two streams of steam 14 and 16 which are kept at different temperatures are supplied from a common supply of steam 20, and a heat sink 22 is included in the process to cool one of the streams, in this instance the second stream of steam 16. The temperature of the non-cooled steam furnished by the common supply of steam 20 can range, according to the relatively hotter of the two streams of steam, somewhere around 115° C. up to around 125° C.

The second stream of steam 16 can be, in accord with the intended purpose, modified by the heat sink 22 into saturated or even wet steam.

The heat sink 22 can be applied to cool the second stream of steam 16 by direct or indirect cooling.

FIG. 1 depicts two streams of media 14 and 16 which are kept at different temperatures and which converge in a nozzle 24, in particular in a spray nozzle, and the web of material, which impinges on this nozzle 24.

Figure 2:
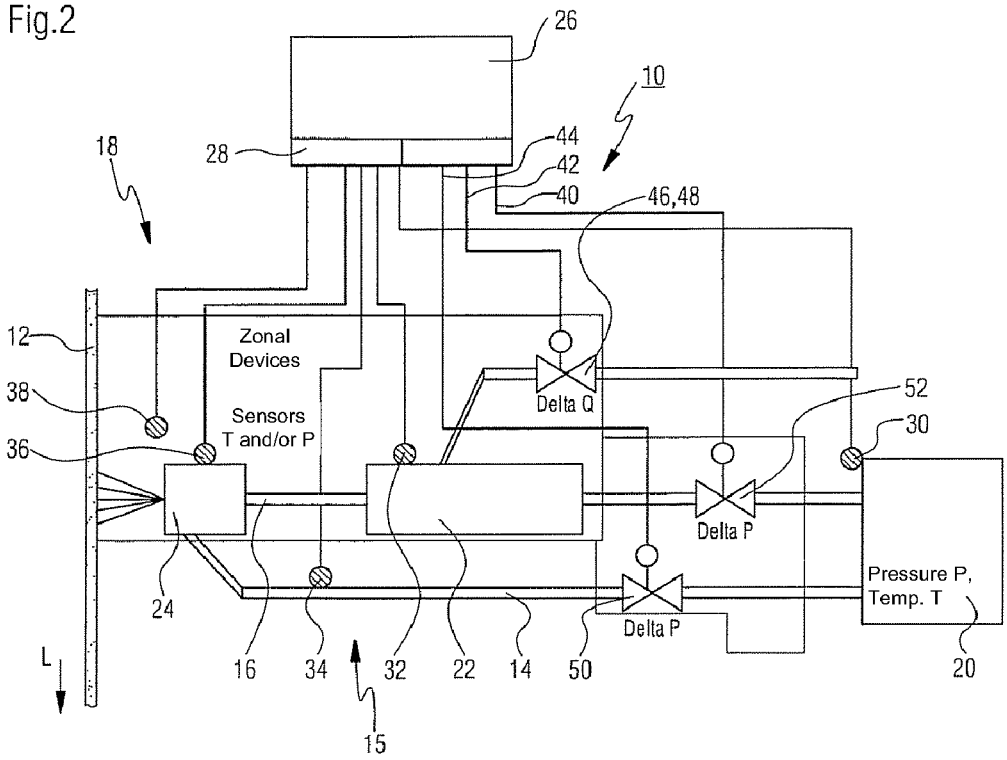
FIG. 2 is a detailed schematic representation of another example of a moisturizing device, where both of the streams of steam, which were kept at different temperatures, are brought back together inside of a nozzle.

FIG. 2 depicts in a detailed schematic another example of this moisturizing device 10, which in general is constructed in the same fashion as the device depicted in FIG. 1. The corresponding components in each figure are labeled with the same reference numbers or symbols. In this particular instance the two streams of media 14 and 16, which are kept at different temperatures, converge again in a nozzle 24 and the web of material 12 impinges on this nozzle 24.

The moisturizing device 10 depicted in FIG. 2, is furthermore shown to contain a control device 26, which might for example be a control computer with multiple channels 28 (which can be referred to as inputs) to connect to various sensors 30 through 38 and with other channels 40 through 44 (which can be referred to as outputs or exits) to connect to various servo components.

As was previously mentioned, the heat sink 22 can be employed for direct or for indirect cooling of the second stream of steam 16, which was kept at the relatively lower temperature.

In the case of direct cooling of the stream of steam 16, it is advantageous to introduce condensate into this stream. It is hereby conceivable to employ a metering device 46 through which the condensate is introduced into the stream of steam 16. In order to control or to facilitate adjustments to the flow of condensate, this metering device 46 can be attached to the exit 42 of the control device 26. The quantity of condensate which is introduced is in this instance being controlled by this metering device 46.

In the case of indirect cooling of the stream of steam 16, the heat sink includes at least one cooling block with its separate coolant cycle. In this instance, the coolant, for example cooling water, is controlled and adjusted through a metering device 48. In this instance, the metering device 48 can be attached to the exit 42 of the control device 26. The metering device 46 can here control or adjust the flow rate of the respective coolant through the cooling block.

In order to control certain properties of the processed web of material 12, in particular its dampness, its shine and its smoothness, additional controls are provided to adjust the volume of the stream of relatively hotter medium 14 and/or the volume of the stream of relatively cooler medium 16. To achieve this effect, a servo component can be employed such as a pressure regulator 50 to influence the stream of steam 14 and/or a servo component can be employed such as a pressure regulator 52 to influence the stream of steam 16. As illustrated in FIG. 2, the pressure regulator 50 can be, for example, attached to the exit 44 of the control device 26, and the pressure regulator 52 can be, for example, attached to the exit 40 of the control device 26.

The pressure regulators 50 and 52 are as previously mentioned optional and can be applied globally or targeted to distinct zones.

For the two streams of steam 14 and 16 a common supply of steam 20 is envisioned, which provides steam with the pressure P and the temperature T.

The channels 28 to the control device 26 are equipped in part with sensors 30-36 to measure the pressure and/or to measure the temperature of the steam in the common supply line 20 of the stream of the relatively hotter steam 14, the steam in the nozzle 24, and the steam impinging on the web of material 12 respectively. As depicted in FIG. 2, one sensor 32 is intended to be employed inside of the heat sink 22.

Optionally, one or more optical sensors 38 could be employed, for example, to monitor the transparency of the steam in order to supply signals representative for the size of droplets and/or the water content of the streams of steam, and/or of the steam impinging on the web of material 12. In the following case, the optical sensor 38 supplies signals to the control device 26 which are representative for the size of droplets and/or the water content of the steam impinging on the web of material 12.

In case the web of material is targeted in distinct zones, there need to be separate components for each individual zone, such as the supply lines for the streams of steam, the respective servo components, the cooling device, the nozzle and/or the sensors.

Figure 3:
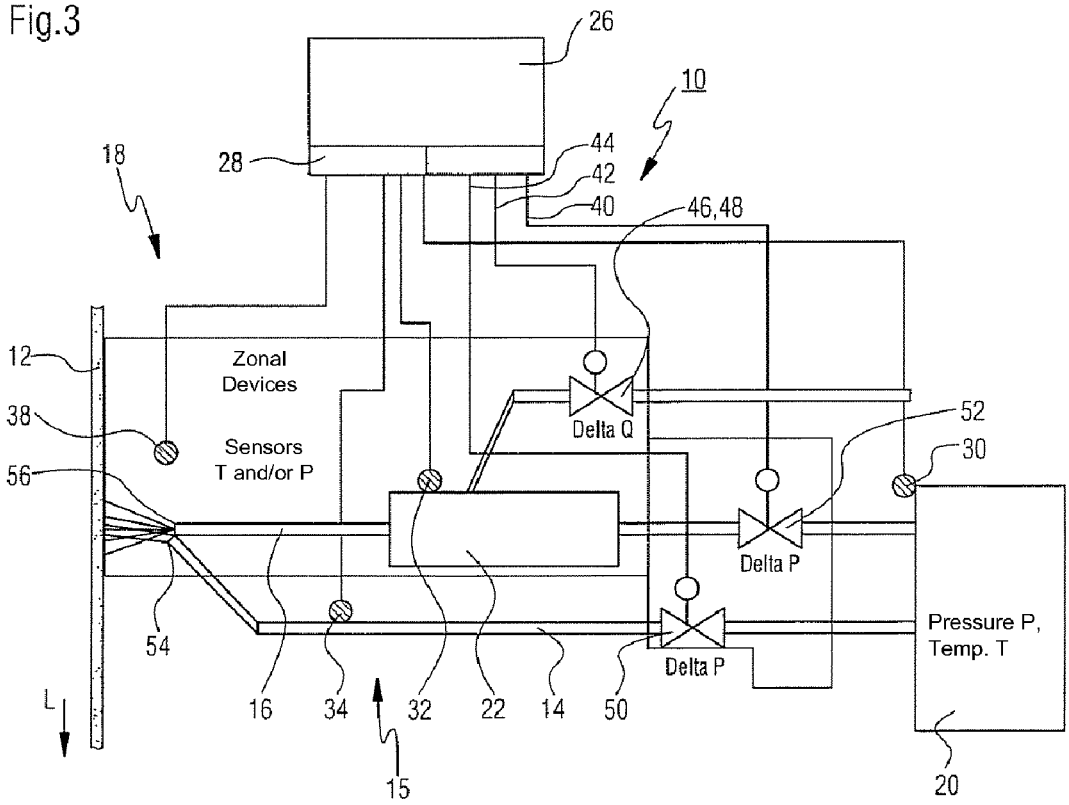
FIG. 3 is a detailed schematic representation of another example of a moisturizing device, where both of the streams of steam, which were kept at different temperatures, are brought back together after exiting their respective nozzles.

FIG. 3 depicts a detailed schematic of another version of the moisturizing device 10.

This moisturizing device 10 differs from the one depicted in FIG. 2 only in that the two streams of steam 14 and 16 which are kept at different temperatures are brought together and mixed into one another after they exit their respective nozzles 54 and 56, respectively, before impinging onto the web of material 12.

The remaining components of the moisturizing device 10, as it is depicted in FIG. 3, are basically arranged in the same fashion as the ones depicted in FIG. 2. The corresponding components in each figure are labeled with the same reference symbols.

In conclusion it remains to be emphasized that the streams of medium 14 and 16 were both depicted as pure examples in these three figures as streams of steam. They could, however, also be conceived as one stream of steam and one stream of gas or something else of that sort.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMBERS

10 moisturizing device
12 web (or layer) of material
14 stream of medium (steam stream) of relatively higher temperature
16 stream of medium (steam stream) of relatively lower temperature
18 steam moistening applicator
20 common supply
22 heat sink, cooling device
24 nozzle
26 control device
28 entrances
30 sensor

32 sensor
34 sensor
36 sensor
38 sensor
40 exit
42 exit
44 exit
46 metering device
48 metering device
50 pressure regulator
52 pressure regulator
54 nozzle
56 nozzle
L direction of movement of the web

What is claimed is:

1. A process to moisten a moving web of material, said process comprising the steps of:

applying moisture through at least two streams of medium which are kept at different temperatures as said at least two streams of medium impinge onto the web, at least one of said at least two streams of medium being a stream of steam.

2. The process according to claim 1, wherein said at least two streams of medium are two streams of steam.

3. The process according to claim 1, wherein said at least two streams of medium are one stream of steam and one stream of a gas.

4. The process according to claim 1, wherein said at least two streams of medium which are kept at different temperatures influence at least one of a moisture profile of the web transversely to a machine direction, a moisture profile of the web in said machine direction, and a moisture level of the web.

5. The process according to claim 4, wherein said moisture is applied in a controlled fashion targeted over different discrete zones across the web and transversely to a direction of movement of the web, in each said zone at least two said streams of medium being applied at different temperatures.

6. The process according to claim 5, wherein said at least two streams of medium include a first stream of medium and a second stream of medium, said first stream of medium being applied at a relatively higher temperature than said second stream of medium and employing a stream of steam, said second stream of medium being applied at a relatively lower temperature than said first stream of medium.

7. The process according to claim 6, wherein said first stream of medium is a superheated stream.

8. A process according to claim 6, wherein at least one of (a) a temperature of said first stream of medium is basically kept constant, and (b) each said zone includes a first stream of medium and a second stream of medium such that a temperature of said first stream of medium distributed across any particular said zone of the web is basically kept constant.

9. The process according to claim 6, wherein each said zone includes a first stream of medium and a second stream of medium, a temperature of said second streams of medium distributed across said zones can each be separately controlled.

10. The process according to claim 6, wherein said first and second streams of medium of different temperature come from a common supply, said second stream of medium being cooled.

11. The process according to claim 10, wherein said first and second streams of medium are streams of steam and said common supply is a steam supply.

12. The process according to claim 10, wherein said second stream of medium is a stream of steam and is converted into one of saturated, supersaturated, and wet steam.

13. The process according to claim 10, wherein a cooling of said second stream of medium is used one of to control and to adjust a volume of said moisture that is applied onto the web.

14. The process according to claim 1, wherein said at least two streams of medium include a first stream of medium and a second stream of medium, said first stream of medium being applied at a relatively higher temperature than said second stream of medium, said second stream of medium being applied at a relatively lower temperature than said first stream of medium, said second stream of medium being cooled directly.

15. The process according to claim 14, wherein a condensate is injected into said second stream of medium in order to provide a direct cooling of said second stream of medium.

16. The process according to claim 15, wherein a volume of said condensate that is introduced into said second stream of medium is controlled by a metering device.

17. The process according to claim 1, wherein said at least two streams of medium include a first stream of medium and a second stream of medium, said first stream of medium being applied at a relatively higher temperature than said second stream of medium, said second stream of medium being applied at a relatively lower temperature than said first stream of medium, said second stream of medium being cooled indirectly.

18. The process according to claim 17, wherein an indirect cooling of said second stream of medium is achieved through at least one heat sink with a separate coolant cycle.

19. The process according to claim 18, wherein a volume of coolant is controlled through a metering device.

20. The process according to claim 1, wherein said at least two streams of medium include a first stream of medium and a second stream of medium, said first stream of medium being applied at a relatively higher temperature than said second stream of medium, said second stream of medium being applied at a relatively lower temperature than said first stream of medium, wherein, in order to control certain properties of a processed said web, a volume of at least one of said first stream of medium and said second stream of medium is adjusted.

21. The process according to claim 1, wherein said two streams of media which are kept at different temperatures converge in a nozzle, the web impinging on this nozzle.

22. The process according to claim 1, wherein said two streams of medium which are kept at different temperatures converge after exiting from respective ones of a plurality of nozzles, said two streams of medium mixing into one another before said two streams of medium impinge on the web.

23. The process according to claim 1, wherein the process is applied to influence at least one of a dampness, a shine, and a smoothness of the web of one of paper and cardboard one of before and at a calender.

* * * * *